US007999491B2

(12) United States Patent
Peng et al.

(10) Patent No.: US 7,999,491 B2
(45) Date of Patent: Aug. 16, 2011

(54) LED LIGHTING CONTROL INTEGRATED CIRCUIT HAVING EMBEDDED PROGRAMMABLE NONVOLATILE MEMORY

(75) Inventors: Sheng-Kai Peng, Yunlin County (TW); Wein-Town Sun, Taoyuan County (TW)

(73) Assignee: eMemory Technology Inc., Hsinchu Science Park, Hsin-Chu (TW)

( * ) Notice: Subject to any disclaimer, the term of this patent is extended or adjusted under 35 U.S.C. 154(b) by 380 days.

(21) Appl. No.: 12/326,872

(22) Filed: Dec. 2, 2008

(65) Prior Publication Data

US 2010/0134020 A1 Jun. 3, 2010

(51) Int. Cl.
*G05F 1/00* (2006.01)
*H05B 37/02* (2006.01)

(52) U.S. Cl. ..... 315/291; 315/307

(58) Field of Classification Search ..... 315/291, 315/307, 224, 209 R, 312
See application file for complete search history.

(56) References Cited

U.S. PATENT DOCUMENTS

| | | | | |
|---|---|---|---|---|
| 6,963,175 | B2 * | 11/2005 | Archenhold et al. | 315/291 |
| 7,180,252 | B2 * | 2/2007 | Lys et al. | 315/312 |
| 7,202,613 | B2 * | 4/2007 | Morgan et al. | 315/312 |
| 2002/0167471 | A1 * | 11/2002 | Everitt | 345/76 |
| 2007/0291483 | A1 * | 12/2007 | Lys | 362/227 |

* cited by examiner

*Primary Examiner* — Douglas W Owens
*Assistant Examiner* — Minh D A
(74) *Attorney, Agent, or Firm* — Winston Hsu; Scott Margo

(57) ABSTRACT

For providing a compact high-precision lighting control means to drive an LED lighting module, a lighting control integrated circuit is set forth to perform an accurate lighting control. At least one nonvolatile memory is embedded in the lighting control integrated circuit for storing a plurality of lookup tables. One lookup table provides related data for setting the driving currents of the LED lighting module based on spacing or pitch of LED disposition of the LED lighting module. Another lookup table provides related data to recover uniformity for different LED damage situations of the LED lighting module. The other lookup tables are applied to perform compensation processes on the driving currents concerning temperature variation, ambient light intensity, aging degradation, and power-on time. In addition, a signal processing unit, a pulse-width-modulation signal generating module, and a driving module are incorporated in the lighting control integrated circuit for signal processing and current driving.

22 Claims, 6 Drawing Sheets

LED LIGHTING CONTROL INTEGRATED CIRCUIT HAVING EMBEDDED PROGRAMMABLE NONVOLATILE MEMORY

BACKGROUND OF THE INVENTION

1. Field of the Invention

The present invention relates to an LED lighting control means, and more particularly, to an LED lighting control integrated circuit having embedded programmable nonvolatile memory.

2. Description of the Prior Art

Due to lightweight, small size, low power consumption and high-bright lighting capability, light emitting diodes (LEDs) are now in widespread use, including a variety of indication applications, indoor or outdoor lighting applications, vehicle auxiliary lighting applications, camera flashlights, backlights for different display panels, and so forth. In advanced applications, LED lighting modules are required to generate light outputs having high-precision luminance and chromaticity. However, the luminance and chromaticity of the light emitted from the LED lighting modules are changed in response to temperature variation, aging degradation, and power-on time, etc. Accordingly, a variety of LED lighting control means are set forth to provide an accurate lighting control for the LED lighting modules so as to generate light outputs having desired luminance and chromaticity.

Please refer to FIG. 1, which is a functional block diagram schematically showing a prior-art LED lighting control device 101. The LED lighting control device 101 is utilized to control an LED lighting module 190. The LED lighting module 190 comprises a red LED unit 191, a green LED unit 192, and a blue LED unit 193. For backlight applications in display panels, a light guide plate and a diffuser are installed for distributing the light emitted from the LED lighting module 190. In general, a photo sensor 197 is attached to the LED lighting module 190 for detecting the intensity of light emitted from the LED lighting module 190 for generating an analog luminance signal. Besides, a temperature sensor 198 is also attached to the LED lighting module 190 for detecting the temperature of the LED lighting module 190 for generating an analog temperature signal.

The LED lighting control device 101 comprises a lookup table (LUT) unit 110, a timer 120, a signal processing unit 130, a pulse-width-modulation (PWM) signal generator 140, a driving circuit 150, and two analog-to-digital converters (ADCs) 187 and 188. The analog-to-digital converter 188 converts the analog temperature signal received from the temperature sensor 198 into a digital temperature signal. The analog-to-digital converter 187 converts the analog luminance signal received from the photo sensor 197 into a digital luminance signal. The timer 120 is utilized to count an accumulated operating time of the LED lighting module 190 for generating a first timing signal. The timer 120 may also function to count an elapsed operating time of the LED lighting module 190 each time after power-on for generating a second timing signal.

The lookup table unit 110 comprises an electrical-erasable programmable read-only-memory (EEPROM) for storing a plurality of lookup tables. The plurality of lookup tables provide information for controlling light outputs of the LED lighting module 190. The information provided by the lookup table unit 110 may comprise compensation data for the red, green, and blue LED units 191-193 concerning temperature variation, aging degradation, and power-on time, etc. That is, the lookup table unit 110 functions to provide compensation data based on the first timing signal, the second timing signal, the digital temperature signal, and the digital luminance signal. The signal processing unit 130 generates control signals Cr, Cg, and Cb based on the compensation data provided by the lookup table unit 110. The PWM signal generator 140 regulates the duty cycles of PWM signals Sr, Sg, and Sb based on the control signals Cr, Cg, and Cb respectively. The driving circuit 150 adjusts the driving currents Ir, Ig, and Ib according to the PWM signals Sr, Sg, and Sb respectively so that the LED lighting module 190 is able to generate light outputs having desired luminance and chromaticity. However, manufacture of the electrical-erasable programmable read-only-memory requires complicated integrated circuit (IC) fabrication processes, and the compensation functionalities of the LED lighting control device 101 cannot meet future demands for advanced performances.

Since the LED lighting control means is required in a variety of LED lighting applications, different compact designs having more compensation or calibration functionalities have been extensively developed uninterruptedly.

SUMMARY OF THE INVENTION

In accordance with an embodiment of the present invention, an LED lighting control integrated circuit for providing a compact high-precision lighting control means to drive an LED lighting module is disclosed. The LED lighting control integrated circuit comprises a first nonvolatile memory, a plurality of first lookup tables, a signal processing unit, a pulse-width-modulation (PWM) signal generating module, and a driving module.

The plurality of first lookup tables are stored in the first nonvolatile memory and comprise a current setting and trimming lookup table for providing a plurality of current setting and trimming calibration signals based on spacing or pitch of LED disposition of an LED lighting module. The signal processing unit is coupled to the first nonvolatile memory for generating a plurality of sets of control signals based on the plurality of current setting and trimming calibration signals. The pulse-width-modulation signal generating module is coupled to the signal processing unit for generating a plurality of sets of PWM signals. The pulse-width-modulation signal generating module comprises a plurality of PWM signal generators. The plurality of PWM signal generators are used to generate the plurality of sets of PWM signals based on the plurality of sets of control signals respectively. The driving module is coupled to the PWM signal generating module for providing a plurality of sets of currents to the LED lighting module. The driving module comprises a plurality of driving circuits. The plurality of driving circuits are coupled to the plurality of PWM signal generators respectively for providing the plurality of sets of currents to the LED lighting module based on the plurality of sets of PWM signals respectively.

In accordance with another embodiment of the present invention, an LED lighting control integrated circuit for providing a compact high-precision lighting control means to drive an LED lighting module is disclosed. The LED lighting control integrated circuit comprises a first nonvolatile memory, a plurality of first lookup tables, a signal processing unit, a pulse-width-modulation signal generating module, a driving module, and a current sensing unit.

The plurality of first lookup tables are stored in the first nonvolatile memory and comprise a uniformity-recovery lookup table for providing a plurality of uniformity-recovery compensation signals according to an LED damage situation of an LED lighting module. The uniformity-recovery lookup table is created based on predetermined uniformity-recovery regulations for recovering spatial uniformity of chromaticity and luminance concerning a variety of LED damage situations of the LED lighting module. The signal processing unit is coupled to the first nonvolatile memory for generating a plurality of sets of control signals based on the plurality of uniformity-recovery compensation signals. The pulse-width-modulation signal generating module is coupled to the signal processing unit for generating a plurality of sets of PWM signals. The pulse-width-modulation signal generating module comprises a plurality of PWM signal generators. The plurality of PWM signal generators are used to generate the plurality of sets of PWM signals based on the plurality of sets of control signals respectively. The driving module is coupled to the PWM signal generating module for providing a plurality of sets of currents to the LED lighting module. The driving module comprises a plurality of driving circuits. The plurality of driving circuits are coupled to the plurality of sets of PWM signal generators respectively for providing the plurality of sets of currents to the LED lighting module based on the plurality of sets of PWM signals respectively. The current sensing unit is coupled to the first nonvolatile memory for generating a plurality of current sensing signals based on the plurality of sets of currents. The LED damage situation of the LED lighting module is determined based on the plurality of current sensing signals.

In accordance with the other embodiment of the present invention, an LED lighting control integrated circuit for providing a compact high-precision lighting control means to drive an LED lighting module is disclosed. The LED lighting control integrated circuit comprises a first nonvolatile memory, a uniformity-recovery lookup table, a signal processing unit, a pulse-width-modulation signal generating module, a driving module, and a current sensing unit.

The uniformity-recovery lookup table is stored in the first nonvolatile memory for providing a plurality of uniformity-recovery compensation signals according to an LED damage situation of an LED lighting module. The uniformity-recovery lookup table is created based on predetermined uniformity-recovery regulations for recovering spatial uniformity of chromaticity and luminance concerning a variety of LED damage situations of the LED lighting module. The signal processing unit is coupled to the first nonvolatile memory for generating a plurality of sets of control signals based on the plurality of uniformity-recovery compensation signals. The pulse-width-modulation signal generating module is coupled to the signal processing unit for generating a plurality of sets of PWM signals. The PWM signal generating module comprises a plurality of PWM signal generators. The plurality of PWM signal generators are used to generate the plurality of sets of PWM signals based on the plurality of sets of control signals respectively. The driving module is coupled to the PWM signal generating module for providing a plurality of sets of currents and a plurality of common voltages to the LED lighting module. The driving module comprises a plurality of driving circuits. The plurality of driving circuits are coupled to the plurality of PWM signal generators respectively for providing the plurality of sets of currents to the LED lighting module based on the plurality of sets of PWM signals respectively. The voltage driving circuit is coupled to the signal processing unit for providing a plurality of common voltages to the LED lighting module based on a voltage control signal generated by the signal processing unit. The current sensing unit is coupled to the first nonvolatile memory, the voltage driving circuit, and the plurality of driving circuits for generating a plurality of current sensing signals based on the plurality of sets of currents and a plurality of output currents from the voltage driving circuit. The LED damage situation of the LED lighting module is determined based on the plurality of current sensing signals.

These and other objectives of the present invention will no doubt become obvious to those of ordinary skill in the art after reading the following detailed description of the preferred embodiment that is illustrated in the various figures and drawings.

DETAILED DESCRIPTION

Hereinafter, preferred embodiments of the present invention will be described in detail with reference to the accompanying drawings. Here, it is to be noted that the present invention is not limited thereto.

Figure 1:
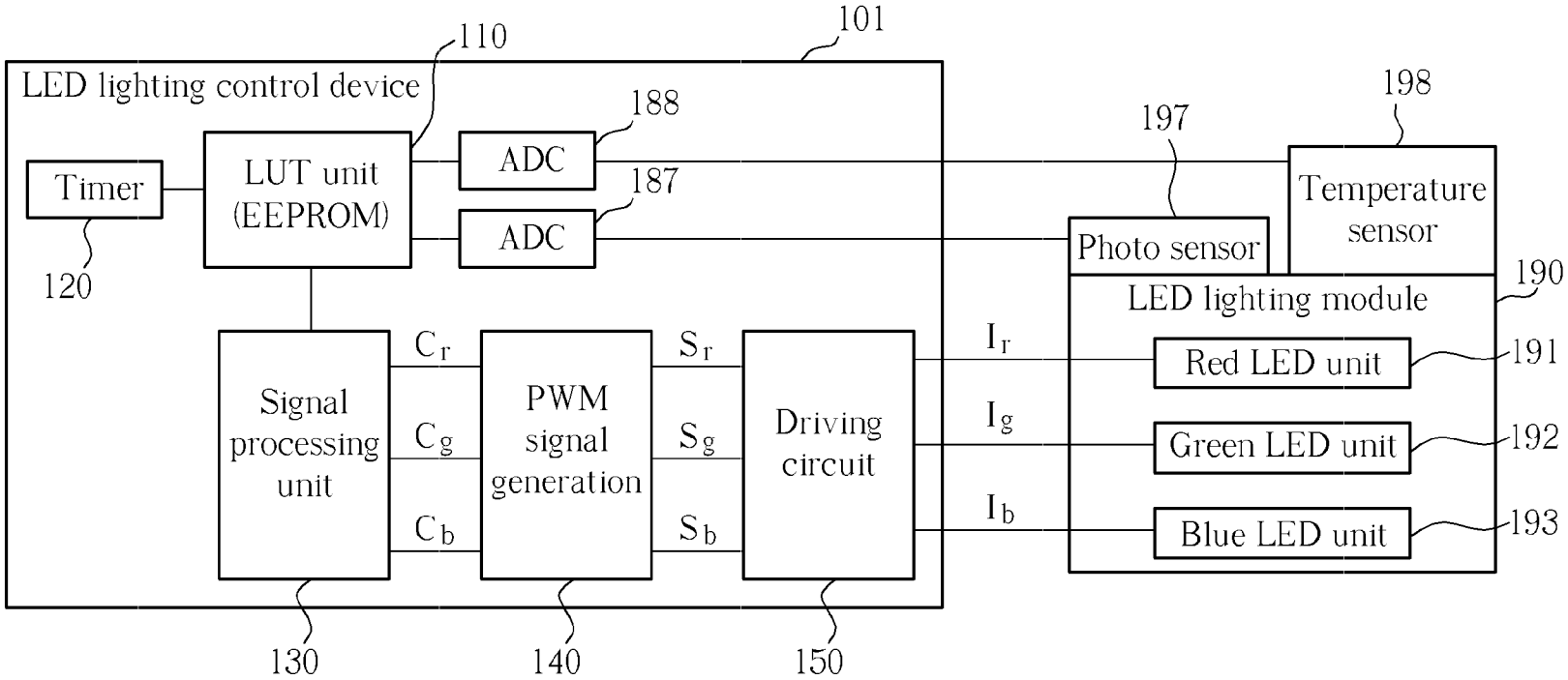
FIG. 1 PRIOR ART
FIG. 1 is a functional block diagram schematically showing a prior-art LED lighting control device.
Figure 2:
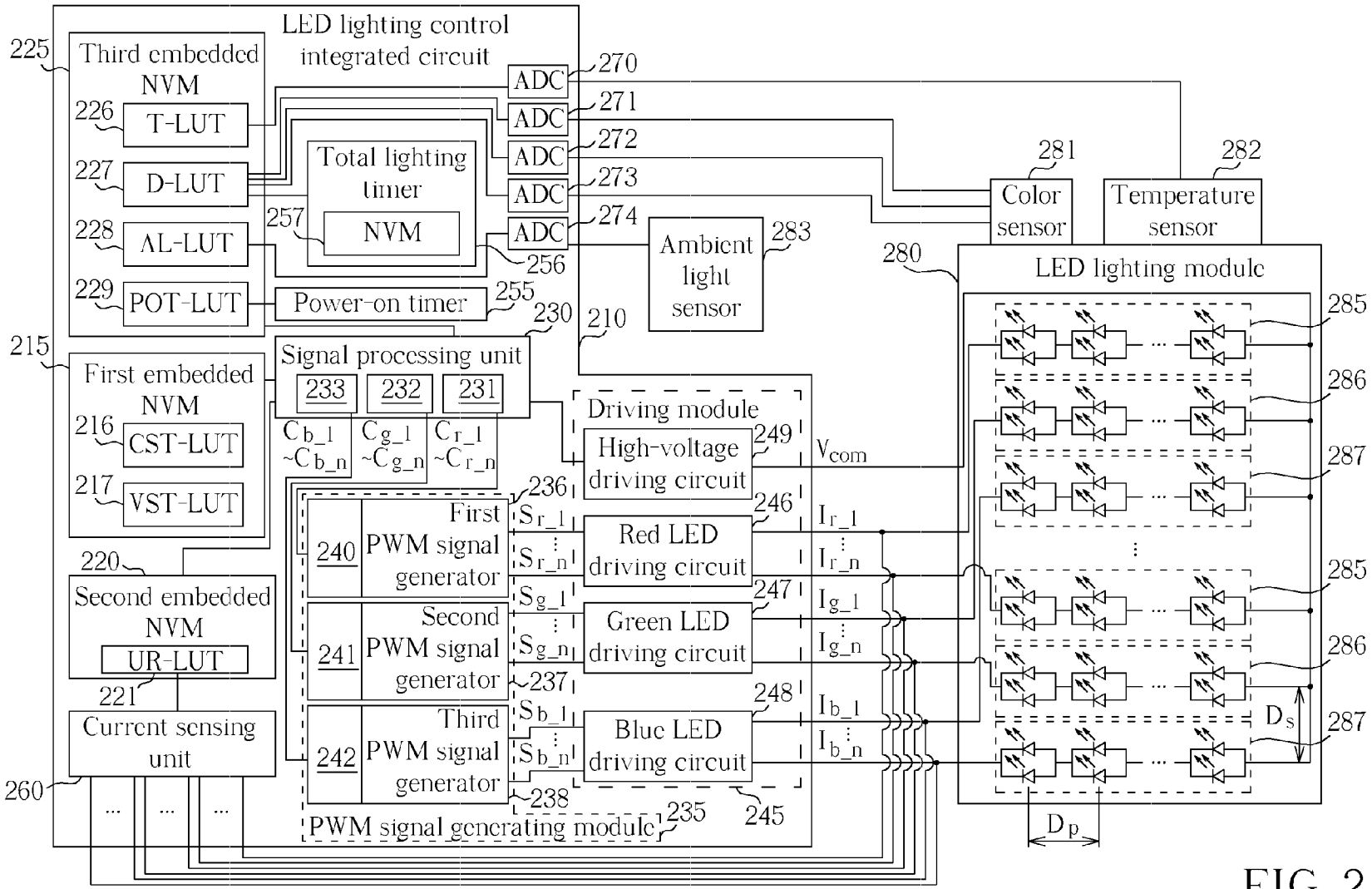
FIG. 2 is a functional block diagram schematically showing an LED lighting control integrated circuit in accordance with a first embodiment of the present invention.

Please refer to FIG. 2, which is a functional block diagram schematically showing an LED lighting control integrated circuit 210 in accordance with a first embodiment of the present invention. The LED lighting control integrated circuit 210 comprises a first embedded nonvolatile memory 215, a second embedded nonvolatile memory 220, a third embedded nonvolatile memory 225, a signal processing unit 230, a pulse-width-modulation (PWM) signal generating module 235, a driving module 245, a power-on timer 255, a total lighting timer 256, a current sensing unit 260, and a plurality of analog-to-digital converters 270-274.

The LED lighting control integrated circuit 210 provides a common voltage Vcom, a plurality of first driving currents Ir_1-Ir_n, a plurality of second driving currents Ig_1-Ig_n, and a plurality of third driving currents Ib_1-$Ib_{13}$ n to an LED lighting module 280. The LED lighting module 280 comprises a plurality of red LED units 285, a plurality of green LED units 286, and a plurality of blue LED units 287. The pluralities of red, green, and blue LED units 285-287 may be disposed based on a direct-type LED backlight design so that the light guide plate can be omitted in backlight applications. Each of the plurality of red, green, and blue LED units 285-287 comprises a plurality of series-connected LED sub-units. Each LED sub-unit comprises a plurality of parallel-connected LEDs.

The temperature sensor 282 is utilized to detect the temperature of the LED lighting module 280 for generating a temperature sensing signal. The analog-to-digital converter 270 is coupled to the temperature sensor 282 for converting the temperature sensing signal in analog form to a temperature sensing signal in digital form. The color sensor 281 is utilized to detect the chromaticity and luminance of the light emitted from the LED lighting module 280 for generating a red-light sensing signal, a green-light sensing signal, and a blue-light sensing signal. The analog-to-digital converters 271 -273 are coupled to the color sensor 281 for converting the red-light, green-light, and blue-light sensing signals in analog form to red-light, green-light, and blue-light sensing signals in digital form.

The ambient light sensor 283 is utilized to detect ambient light for generating an ambient light sensing signal. The analog-to-digital converter 274 is coupled to the ambient light sensor 283 for converting the ambient light sensing signal in analog form to an ambient light sensing signal in digital form. In one embodiment, if the color sensor 381, the temperature sensor 382, or the ambient light sensor 383 is incorporated with an analog-to-digital converter, then the corresponding analog-to-digital converter in the LED lighting control integrated circuit 210 can be omitted.

The first embedded nonvolatile memory 215 is coupled to the signal processing unit 230. A current setting and trimming lookup table (CST-LUT) 216 is stored in the first embedded nonvolatile memory 215 for providing a plurality of current setting and trimming calibration signals based on the spacing Ds or the pitch Dp corresponding to the LED disposition of the LED lighting module 280 as shown in FIG. 2. A voltage setting and trimming lookup table (VST-LUT) 217 is stored in the first embedded nonvolatile memory 215 for providing a voltage setting and trimming calibration signal based the number of series-connected LED sub-units in each red, green, or blue LED unit of the LED lighting module 280. The first embedded nonvolatile memory 215 is a one time programmable nonvolatile memory or a multiple time programmable nonvolatile memory.

The second embedded nonvolatile memory 220 is coupled to the signal processing unit 230. A uniformity-recovery lookup table (UR-LUT) 221 is stored in the second embedded nonvolatile memory 220 for providing a plurality of uniformity-recovery compensation signals according to an LED damage situation of the LED lighting module 280. The uniformity-recovery lookup table 221 is created based on predetermined uniformity-recovery regulations for recovering spatial uniformity of chromaticity and luminance concerning a variety of LED damage situations of the LED lighting module 280. The second embedded nonvolatile memory 220 is a one time programmable nonvolatile memory or a multiple time programmable nonvolatile memory. In a preferred embodiment, the second embedded nonvolatile memory 220 is a multiple time programmable nonvolatile memory.

The third embedded nonvolatile memory 225 is coupled to the signal processing unit 230, the power-on timer 255, the total lighting timer 256, and the plurality of analog-to-digital converters 270-274. A temperature-related lookup table (T-LUT) 226 is stored in the third embedded nonvolatile memory 225 for providing a plurality of temperature-related compensation signals based on the temperature sensing signal. An ambient-light-related lookup table (AL-LUT) 228 is stored in the third embedded nonvolatile memory 225 for providing a plurality of ambient-light-related compensation signals based on the ambient light sensing signal. The third embedded nonvolatile memory 225 is a one time programmable nonvolatile memory or a multiple time programmable nonvolatile memory. In a preferred embodiment, the third embedded nonvolatile memory 225 is a one time programmable nonvolatile memory.

The power-on timer 255 functions to count an elapsed operating time of the LED lighting module 280 each time after power-on. A power-on-time-related lookup table (POT-LUT) 229 is stored in the third embedded nonvolatile memory 225 for providing a plurality of power-on-time-related compensation signals based on the elapsed operating time. The total lighting timer 256 functions to count an accumulated operating time of the LED lighting module 280. The total lighting timer 256 comprises an embedded nonvolatile memory 257 for storing the accumulated operating time. The embedded nonvolatile memory 257 is a multiple time programmable nonvolatile memory or a pseudo multiple time programmable nonvolatile memory. The pseudo multiple time programmable nonvolatile memory is actually a one multiple time programmable nonvolatile memory having a memory space available for writing data sequentially but incapable of erasing written data. A degradation-related lookup table (D-LUT) 227 is stored in the third embedded nonvolatile memory 225 for providing a plurality of degradation-related compensation signals based on the accumulated operating time. Alternatively, the degradation-related lookup table 227 may provide the plurality of degradation-related compensation signals based on the red-light, green-light, and blue-light sensing signals in digital form.

The signal processing unit 230 is coupled to the first, second, and third nonvolatile memories 215, 220, 225 for receiving the current setting and trimming calibration signals, the voltage setting and trimming calibration signal, the uniformity-recovery compensation signals, the temperature-related compensation signals, the ambient-light-related compensation signals, the power-on-time-related compensation signals, and the degradation-related compensation signals. The signal processing unit 230 is utilized to perform signal processing on the current setting and trimming calibration signals, the uniformity-recovery compensation signals, the temperature-related compensation signals, the ambient-light-related compensation signals, the power-on-time-related compensation signals, or the degradation-related compensation signals for generating a plurality of first control signals Cr_1-Cr_n, a plurality of second control signals Cg_1-Cg_n, and a plurality of third control signals Cb__1-Cb_n. The signal processing unit 230 comprises a first buffer 231, a second buffer 232, and a third buffer 233. The first buffer 231 is used to output the plurality of first control signals Cr_1-Cr_n based on serial-transmitting mode. The second buffer 232 is used to output the plurality of second control signals Cg_1-Cg_n based on serial-transmitting mode. The third buffer 232 is used to output the plurality of third control signals Cb_1-Cb_n based on serial-transmitting mode. In addition, the signal processing unit 230 is able to perform signal processing on the voltage setting and trimming calibration signal for generating a voltage control signal.

The pulse-width-modulation signal generating module 235 comprises a first PWM signal generator 236, a second PWM signal generator 237, a third PWM signal generator 238, a fourth buffer 240, a fifth buffer 241, and a sixth buffer 242. The fourth buffer 240 is coupled between the first buffer 231 and the first PWM signal generator 236 for transferring the plurality of first control signals Cr_1-Cr_n from the first buffer 231 to the first PWM signal generator 236. The fifth buffer 241 is coupled between the second buffer 232 and the second PWM signal generator 237 for transferring the plurality of second control signals Cg_1-Cg_n from the second buffer 232 to the second PWM signal generator 237. The sixth buffer 242 is coupled between the third buffer 233 and the third PWM signal generator 238 for transferring the plurality of third control signals Cb_1-Cb_n from the third buffer 233 to the third PWM signal generator 238. In one embodiment, the first to sixth buffers 231-233 and 240-242 can be omitted and the pluralities of first, second, and third control signals are transferred from the signal processing unit 230 directly to the first, second, and third PWM signal generators 236-238 respectively.

The first PWM signal generator 236 generates a plurality of first PWM signals Sr_1-Sr_n based on the plurality of first control signals Cr_1-Cr_n. The second PWM signal generator 237 generates a plurality of second PWM signals Sg_1-Sg_n based on the plurality of second control signals Cg_1-Cg_n. The third PWM signal generator 238 generates a plurality of third PWM signals Sb_1-Sb_n based on the plurality of third control signals Cb_1-Cb_n.

The driving module 245 comprises a red LED driving circuit 246, a green LED driving circuit 247, a blue LED driving circuit 248, and a high-voltage driving circuit 249. The red LED driving circuit 246 is coupled to the first PWM signal generator 236 for generating the plurality of first driving currents Ir_1-Ir_n according to the plurality of first PWM signals Sr_1-Sr_n respectively. The green LED driving circuit 247 is coupled to the second PWM signal generator 237 for generating the plurality of second driving currents Ig_1-Ig_n according to the plurality of second PWM signals Sg_1-Sg_n respectively. The blue LED driving circuit 248 is coupled to the third PWM signal generator 238 for generating the plurality of third driving currents Ib_1-Ib_n according to the plurality of third PWM signals Sb_1-Sb_n respectively. The high-voltage driving circuit 249 is coupled to the signal processing unit 230 for generating the common voltage Vcom according to the voltage control signal.

The current sensing unit 260 is utilized to sense the plurality of first driving currents Ir_1-Ir_n, the plurality of second driving currents Ig_1-Ig_n, and the plurality of third driving currents Ib_1-Ib_n for generating a plurality of current sensing signals. Accordingly, the LED damage situation of the LED lighting module 280 can be determined based on the plurality of current sensing signals so that the uniformity-recovery lookup table 221 is able to provide the plurality of uniformity-recovery compensation signals based on the plurality of current sensing signals for recovering spatial uniformity of chromaticity and luminance concerning the light emitted from the LED lighting module 280 when an LED damage situation occurs to the LED lighting module 280.

The LED lighting control integrated circuit 210 is fabricated based on a Bipolar-CMOS-DMOS (BCD) IC fabrication process or a High-Voltage (HV) IC fabrication process. That is, the fabrication processes of the one time programmable nonvolatile memory, the pseudo multiple time programmable nonvolatile memory, and the multiple time programmable nonvolatile memory are compatible to the Bipolar-CMOS-DMOS IC fabrication process or the High-Voltage IC fabrication process.

In summary, the LED lighting control integrated circuit 210 provides a compact high-precision lighting control means for driving the LED lighting module 280 based on the temperature variation, the ambient light intensity, the power-on time, the aging degradation, the chromaticity and luminance of the light emitted from the LED lighting module 280, the LED disposition of the LED lighting module 280, or the LED damage situation of the LED lighting module 280. Moreover, the fabrication process of the embedded nonvolatile memory used in the LED lighting control integrated circuit 210 is less complicated than the fabrication process of the electrical-erasable programmable read-only-memory used in the prior-art LED lighting control device.

Figure 3:
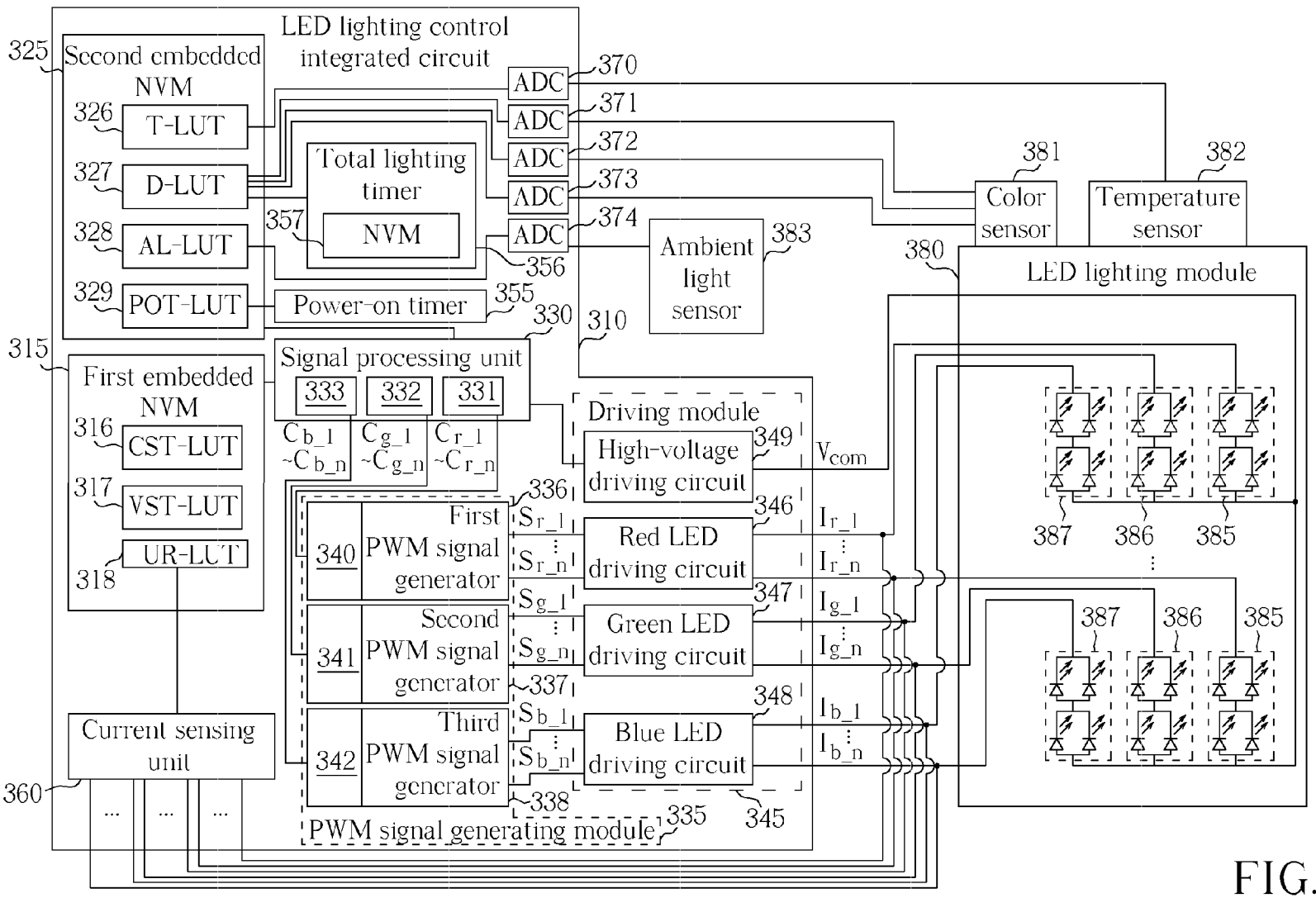
FIG. 3 is a functional block diagram schematically showing an LED lighting control integrated circuit in accordance with a second embodiment of the present invention.

Please refer to FIG. 3, which is a functional block diagram schematically showing an LED lighting control integrated circuit 310 in accordance with a second embodiment of the present invention. The LED lighting control integrated circuit 310 comprises a first embedded nonvolatile memory 315, a second embedded nonvolatile memory 325, a signal processing unit 330, a pulse-width-modulation signal generating module 335, a driving module 345, a power-on timer 355, a total lighting timer 356, a current sensing unit 360, and a plurality of analog-to-digital converters 370-374.

The first embedded nonvolatile memory 315 stores a current setting and trimming lookup table 316, a voltage setting and trimming lookup table 317, and a uniformity-recovery lookup table 318. The first embedded nonvolatile memory 315 is a one time programmable nonvolatile memory or a multiple time programmable nonvolatile memory. In a preferred embodiment, the first embedded nonvolatile memory 315 is a multiple time programmable nonvolatile memory. The second embedded nonvolatile memory 325 stores a temperature-related lookup table 326, a degradation-related lookup table 327, an ambient-light-related lookup table 328, and a power-on-time-related lookup table 329. The second embedded nonvolatile memory 325 is a one time programmable nonvolatile memory or a multiple time programmable nonvolatile memory. In a preferred embodiment, the second embedded nonvolatile memory 325 is a one time programmable nonvolatile memory.

The signal processing unit 330 comprises a first buffer 331, a second buffer 332, and a third buffer 333. The pulse-width-modulation signal generating module 335 comprises a first PWM signal generator 336, a second PWM signal generator 337, a third PWM signal generator 338, a fourth buffer 340, a fifth buffer 341, and a sixth buffer 342. The driving module 345 comprises a red LED driving circuit 346, a green LED driving circuit 347, a blue LED driving circuit 348, and a high-voltage driving circuit 349. The total lighting timer 356 comprises an embedded nonvolatile memory 357.

The LED lighting control integrated circuit 310 provides a common voltage Vcom, a plurality of first driving currents Ir_1-Ir_n, a plurality of second driving currents Ig_1-Ig_n, and a plurality of third driving currents Ib_1-Ib_n to an LED lighting module 380. The LED lighting module 380 comprises a plurality of red LED units 385, a plurality of green LED units 386, and a plurality of blue LED units 387. The pluralities of red, green, and blue LED units 385-387 may be disposed based on a direct-type LED backlight design so that the light guide plate can be omitted in backlight applications. Each of the plurality of red, green, and blue LED units 385-387 comprises a plurality of series-connected LED sub-units. Each LED sub-unit comprises a plurality of parallel-connected LEDs. The functions of the temperature sensor 382, the color sensor 381, and the ambient light sensor 383 shown in FIG. 3 are the same as the functions of the temperature sensor 282, the color sensor 281, and the ambient light sensor 283 shown in FIG. 2 respectively.

The structure of the LED lighting control integrated circuit 310 is similar to the structure of the LED lighting control integrated circuit 210, differing only in that the current setting and trimming lookup table 316, the voltage setting and trimming lookup table 317, and the uniformity-recovery lookup table 318 are all stored in the first embedded nonvolatile memory 315. The coupling arrangements and related functionalities concerning the other elements in the LED lighting control integrated circuit 310 are similar to the coupling arrangements and related functionalities detailed for the corresponding elements in the LED lighting control integrated circuit 210 shown in FIG. 2, and for the sake of brevity, further description on the LED lighting control integrated circuit 310 are omitted.

Figure 4:
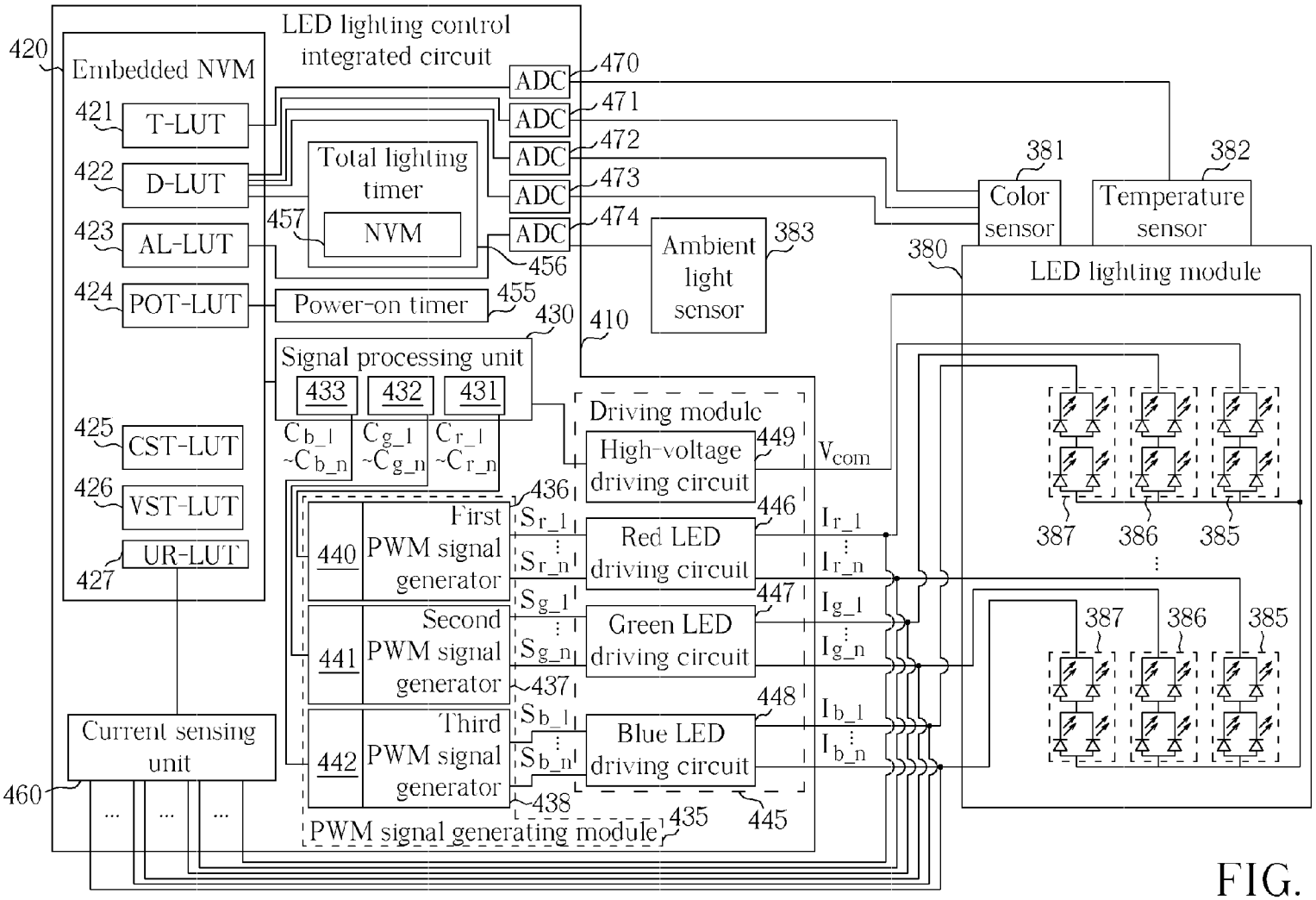
FIG. 4 is a functional block diagram schematically showing an LED lighting control integrated circuit in accordance with a third embodiment of the present invention.

Please refer to FIG. 4, which is a functional block diagram schematically showing an LED lighting control integrated circuit 410 in accordance with a third embodiment of the present invention. The LED lighting control integrated circuit 410 comprises an embedded nonvolatile memory 420, a signal processing unit 430, a pulse-width-modulation signal generating module 435, a driving module 445, a power-on timer 455, a total lighting timer 456, a current sensing unit 460, and a plurality of analog-to-digital converters 470-474.

The embedded nonvolatile memory 420 stores a temperature-related lookup table 421, a degradation-related lookup table 422, an ambient-light-related lookup table 423, a power-on-time-related lookup table 424, a current setting and trimming lookup table 425, a voltage setting and trimming lookup table 426, and a uniformity-recovery lookup table 427. The embedded nonvolatile memory 420 is a one time programmable nonvolatile memory or a multiple time programmable nonvolatile memory. In a preferred embodiment, the embedded nonvolatile memory 420 is a multiple time programmable nonvolatile memory.

The signal processing unit 430 comprises a first buffer 431, a second buffer 432, and a third buffer 433. The pulse-width-modulation signal generating module 435 comprises a first PWM signal generator 436, a second PWM signal generator 437, a third PWM signal generator 438, a fourth buffer 440, a fifth buffer 441, and a sixth buffer 442. The driving module 445 comprises a red LED driving circuit 446, a green LED driving circuit 447, a blue LED driving circuit 448, and a high-voltage driving circuit 449. The total lighting timer 456 comprises an embedded nonvolatile memory 457.

The structure of the LED lighting control integrated circuit 410 is similar to the structure of the LED lighting control integrated circuit 210, differing only in that the temperature-related lookup table 421, the degradation-related lookup table 422, the ambient-light-related lookup table 423, the power-on-time-related lookup table 424, the current setting and trimming lookup table 425, the voltage setting and trimming lookup table 426, and the uniformity-recovery lookup table 427 are all stored in the embedded nonvolatile memory 420. The coupling arrangements and related functionalities concerning the other elements in the LED lighting control integrated circuit 410 are similar to the coupling arrangements and related functionalities detailed for the corresponding elements in the LED lighting control integrated circuit 210 shown in FIG. 2, and for the sake of brevity, further description on the LED lighting control integrated circuit 410 are omitted.

Figure 5:
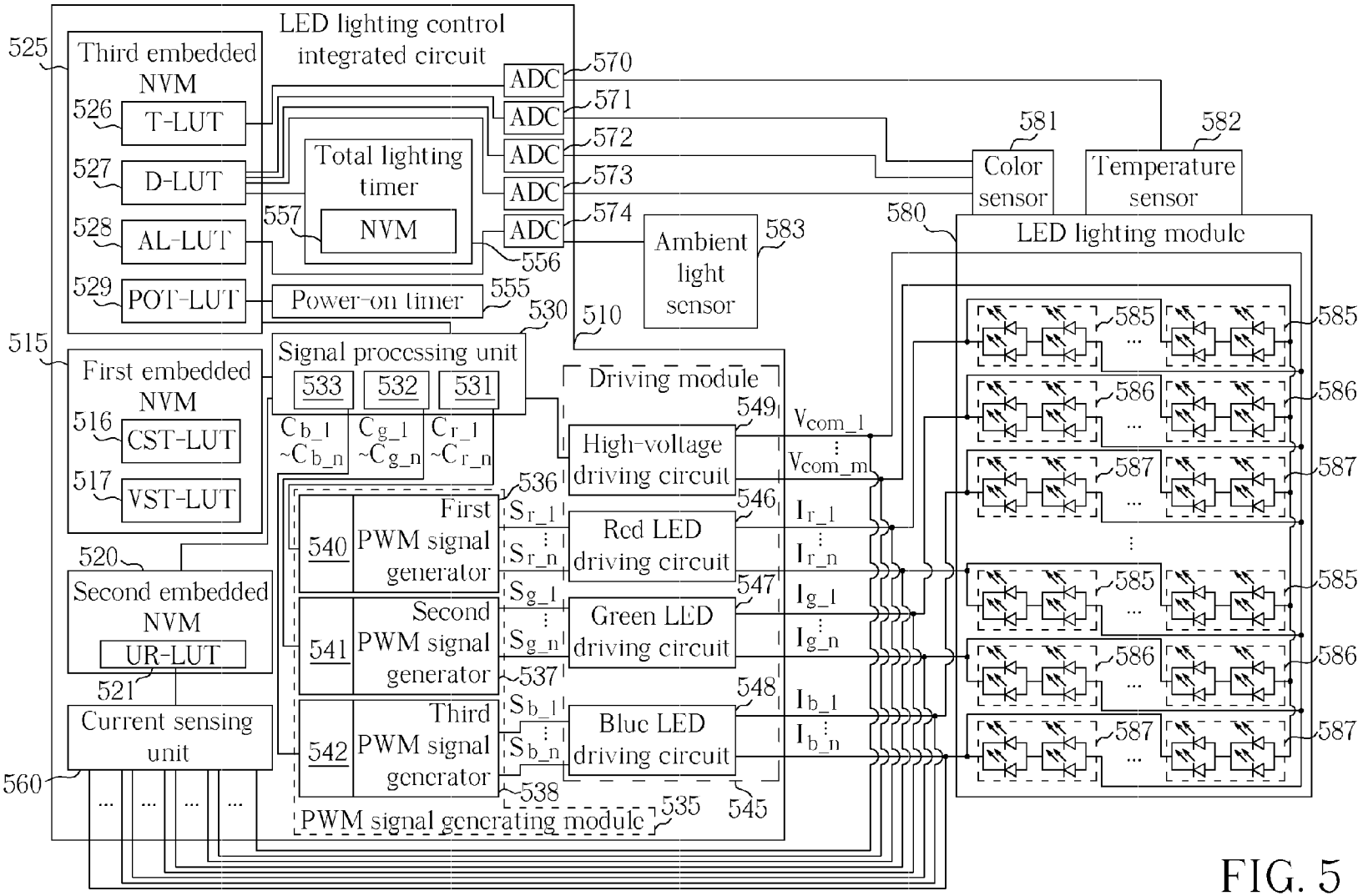
FIG. 5 is a functional block diagram schematically showing an LED lighting control integrated circuit in accordance with a fourth embodiment of the present invention.

Please refer to FIG. 5, which is a functional block diagram schematically showing an LED lighting control integrated circuit 510 in accordance with a fourth embodiment of the present invention. The LED lighting control integrated circuit 510 comprises a first embedded nonvolatile memory 515, a second embedded nonvolatile memory 520, a third embedded nonvolatile memory 525, a signal processing unit 530, a pulse-width-modulation signal generating module 535, a driving module 545, a power-on timer 555, a total lighting timer 556, a current sensing unit 560, and a plurality of analog-to-digital converters 570-574.

The first embedded nonvolatile memory 515 stores a current setting and trimming lookup table 516 and a voltage setting and trimming lookup table 517. The second embedded nonvolatile memory 520 stores a uniformity-recovery lookup table 521. The third embedded nonvolatile memory 525 stores a temperature-related lookup table 526, a degradation-related lookup table 527, an ambient-light-related lookup table 528, and a power-on-time-related lookup table 529. The signal processing unit 530 comprises a first buffer 531, a second buffer 532, and a third buffer 533. The pulse-width-modulation signal generating module 535 comprises a first PWM signal generator 536, a second PWM signal generator 537, a third PWM signal generator 538, a fourth buffer 540, a fifth buffer 541, and a sixth buffer 542. The total lighting timer 556 comprises an embedded nonvolatile memory 557.

The driving module 545 comprises a red LED driving circuit 546, a green LED driving circuit 547, a blue LED driving circuit 548, and a high-voltage driving circuit 549. The high-voltage driving circuit 549 comprises a plurality of output ports for providing a plurality of common voltages Vcom_1 -Vcom_m. The plurality of common voltages Vcom_1 -Vcom_m can be regulated based on a voltage control signal which is generated by the signal processing unit 530 based on a voltage setting and trimming calibration signal provided by the voltage setting and trimming lookup table 517. The red LED driving circuit 546 comprises a plurality of output ports for providing a plurality of first driving currents Ir_1-Ir_n. The green LED driving circuit 547 comprises a plurality of output ports for providing a plurality of second driving currents Ig_1-Ig_n. The blue LED driving circuit 548 comprises a plurality of output ports for providing a plurality of third driving currents Ib_1-Ib_n.

The LED lighting control integrated circuit 510 provides the plurality of common voltages Vcom_1 -Vcom_m, the plurality of first driving currents Ir_1-Ir_n, the plurality of second driving currents Ig_1-Ig_n, and the plurality of third driving currents Ib_1-Ib_n to an LED lighting module 580. The LED lighting module 580 comprises a plurality of red LED units 585, a plurality of green LED units 586, and a plurality of blue LED units 587. The pluralities of red, green, and blue LED units 585-587 may be disposed based on a direct-type LED backlight design so that the light guide plate can be omitted in backlight applications. Each of the plurality of red, green, and blue LED units 585-587 comprises a plurality of series-connected LED sub-units. Each LED sub-unit comprises a plurality of parallel-connected LEDs. Each red LED unit 585 is coupled between a corresponding output port of the red LED driving circuit 546 and a corresponding output port of the high-voltage driving circuit 549. Each green LED unit 586 is coupled between a corresponding output port of the green LED driving circuit 547 and a corresponding output port of the high-voltage driving circuit 549. Each blue LED unit 587 is coupled between a corresponding output port of the blue LED driving circuit 548 and a corresponding output port of the high-voltage driving circuit 549. The functions of the temperature sensor 582, the color sensor 581, and the ambient light sensor 583 shown in FIG. 5 are the same as the functions of the temperature sensor 282, the color sensor 281, and the ambient light sensor 283 shown in FIG. 2 respectively.

The current sensing unit 560 is utilized to sense the plurality of first driving currents Ir_1-Ir_n, the plurality of second driving currents Ig_1-Ig_n, and the plurality of third driving currents Ib_1-Ib_n for generating a plurality of first current sensing signals. Furthermore, the current sensing unit 560 senses a plurality of output currents from the output ports of the high-voltage driving circuit 549 for generating a plurality of second current sensing signals. Accordingly, the LED damage situation of the LED lighting module 580 can be determined based on the plurality of first current sensing signals in conjunction with the plurality of second current sensing signals. That is, the uniformity-recovery lookup table 521 is able to provide a plurality of uniformity-recovery compensation signals based on the plurality of first current sensing signals and the plurality of second current sensing signals for recovering spatial uniformity of chromaticity and luminance concerning the light emitted from the LED lighting module 580 when an LED damage situation occurs to the LED lighting module 580.

The structure of the LED lighting control integrated circuit 510 is similar to the structure of the LED lighting control integrated circuit 210, differing only in that the high-voltage driving circuit 549 is utilized to provide the plurality of common voltages Vcom_1 -Vcom_m instead of just the common voltage Vcom, and the current sensing unit 560 further generates the additional second current sensing signals based on the output currents from the high-voltage driving circuit 549. That is, the LED damage situation of the LED lighting module 580 is determined by means of a two-dimensional addressing method based on the pluralities of first and second current sensing signals instead of the aforementioned determination method that is basically a one-dimensional addressing method. The coupling arrangements and related functionalities concerning the other elements in the LED lighting control integrated circuit 510 are similar to the coupling arrangements and related functionalities detailed for the corresponding elements in the LED lighting control integrated circuit 210 shown in FIG. 2, and for the sake of brevity, further description on the LED lighting control integrated circuit 510 are omitted.

Figure 6:
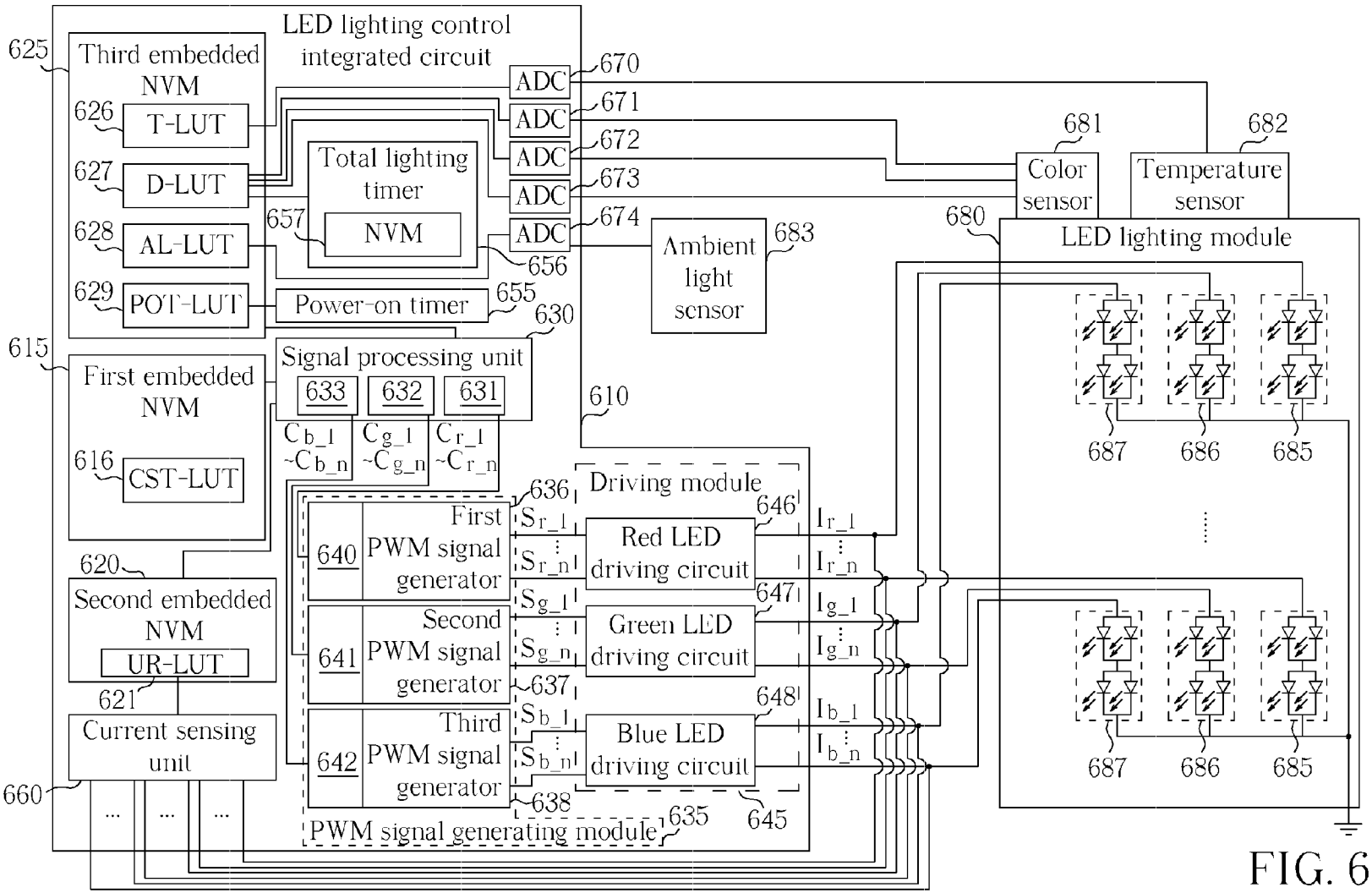
FIG. 6 is a functional block diagram schematically showing an LED lighting control integrated circuit in accordance with a fifth embodiment of the present invention.

Please refer to FIG. 6, which is a functional block diagram schematically showing an LED lighting control integrated circuit 610 in accordance with a fifth embodiment of the present invention. The LED lighting control integrated circuit 610 comprises a first embedded nonvolatile memory 615, a second embedded nonvolatile memory 620, a third embedded nonvolatile memory 625, a signal processing unit 630, a pulse-width-modulation signal generating module 635, a driving module 645, a power-on timer 655, a total lighting timer 656, a current sensing unit 660, and a plurality of analog-to-digital converters 670-674.

The first embedded nonvolatile memory 615 stores a current setting and trimming lookup table 616. The second embedded nonvolatile memory 620 stores a uniformity-recovery lookup table 621. The third embedded nonvolatile memory 625 stores a temperature-related lookup table 626, a degradation-related lookup table 627, an ambient-light-related lookup table 628, and a power-on-time-related lookup table 629. The signal processing unit 630 comprises a first buffer 631, a second buffer 632, and a third buffer 633. The pulse-width-modulation signal generating module 635 comprises a first PWM signal generator 636, a second PWM signal generator 637, a third PWM signal generator 638, a fourth buffer 640, a fifth buffer 641, and a sixth buffer 642. The total lighting timer 656 comprises an embedded nonvolatile memory 657. The driving module 645 comprises a red LED driving circuit 646, a green LED driving circuit 647, and a blue LED driving circuit 648. The red LED driving circuit 646 comprises a plurality of output ports for providing a plurality of first driving currents Ir_1-Ir_n. The green LED driving circuit 647 comprises a plurality of output ports for providing a plurality of second driving currents Ig_1-Ig_n. The blue LED driving circuit 648 comprises a plurality of output ports for providing a plurality of third driving currents Ib_1-Ib_n.

The LED lighting control integrated circuit 610 provides the plurality of first driving currents Ir_1-Ir_n, the plurality of second driving currents Ig_1-Ig_n, and the plurality of third driving currents Ib_1-Ib_n to an LED lighting module 680. The LED lighting module 680 comprises a plurality of red LED units 685, a plurality of green LED units 686, and a plurality of blue LED units 687. The pluralities of red, green, and blue LED units may be disposed based on a direct-type LED backlight design so that the light guide plate can be omitted in backlight applications. Each of the plurality of red, green, and blue LED units 685-687 comprises a plurality of series-connected LED sub-units. Each LED sub-unit comprises a plurality of parallel-connected LEDs. Each red LED unit 685 is coupled between a corresponding output port of the red LED driving circuit 646 and a ground terminal. Each green LED unit 686 is coupled between a corresponding output port of the green LED driving circuit 647 and the ground terminal. Each blue LED unit 687 is coupled between a corresponding output port of the blue LED driving circuit 648 and the ground terminal. The functions of the temperature sensor 682, the color sensor 681, and the ambient light sensor 683 shown in FIG. 6 are the same as the functions of the temperature sensor 282, the color sensor 281, and the ambient light sensor 283 shown in FIG. 2 respectively.

The structure of the LED lighting control integrated circuit 610 is similar to the structure of the LED lighting control integrated circuit 210, differing only in that the high-voltage driving circuit 249 is omitted in the driving module 645, and the voltage setting and trimming lookup table 217 is omitted in the first embedded nonvolatile memory 615. That is, the red LED driving circuit 646, the green LED driving circuit 647, and the blue LED driving circuit 645 are used to provide forward currents to the LED lighting module 680 instead of sink currents. The coupling arrangements and related functionalities concerning the other elements in the LED lighting control integrated circuit 610 are similar to the coupling arrangements and related functionalities detailed for the corresponding elements in the LED lighting control integrated circuit 210 shown in FIG. 2, and for the sake of brevity, further description on the LED lighting control integrated circuit 610 are omitted.

To sum up, the LED lighting control integrated circuit of the present invention provides a compact high-precision lighting control means for driving an LED lighting module based on the temperature variation, the ambient light intensity, the power-on time, the aging degradation, the chromaticity and luminance of the light emitted from the LED lighting module, the LED disposition of the LED lighting module, or the LED damage situation of the LED lighting module. The LED damage situation of the LED lighting module can be determined by means of one-dimensional or two-dimensional addressing method according to the LED disposition of the LED lighting module. All the fabrication processes of the LED lighting control integrated circuit are performed based on the Bipolar-CMOS-DMOS IC fabrication process or the High-Voltage IC fabrication process. That is, the fabrication processes of the embedded nonvolatile memories used in the LED lighting control integrated circuit are less complicated than the fabrication processes of the electrical-erasable programmable read-only-memory used in the prior-art LED lighting control device.

The present invention is by no means limited to the embodiments as described above by referring to the accompanying drawings, which may be modified and altered in a variety of different ways without departing from the scope of the present invention. Thus, it should be understood by those skilled in the art that various modifications, combinations, sub-combinations and alternations might occur depending on design requirements and other factors insofar as they are within the scope of the appended claims or the equivalents thereof.

What is claimed is:

1. An LED lighting control integrated circuit comprising:

a first nonvolatile memory;

a plurality of first lookup tables stored in the first nonvolatile memory comprising a current setting and trimming lookup table for providing a plurality of current setting and trimming calibration signals based on spacing or pitch of LED disposition of an LED lighting module;

a first timer for counting an elapsed operating time of the LED lighting module each time after power-on;

a second nonvolatile memory coupled to the first timer;

a power-on-time-related lookup table, stored in the second nonvolatile memory, for providing a plurality of power-on-time-related compensation signals based on the elapsed operating time;

a signal processing unit, coupled to the first nonvolatile memory and the second nonvolatile memory, for generating a plurality of sets of control signals based on the plurality of current setting and trimming calibration signals in conjunction with the power-on-time-related compensation signals;

a pulse-width-modulation (PWM) signal generating module coupled to the signal processing unit for generating a plurality of sets of PWM signals, the PWM signal generating module comprising:

a plurality of PWM signal generators for generating the plurality of sets of PWM signals based on the plurality of sets of control signals respectively; and a driving module coupled to the PWM signal generating module for providing a plurality of sets of currents to the LED lighting module, the driving module comprising:

a plurality of driving circuits coupled to the plurality of PWM signal generators respectively for providing the plurality of sets of currents to the LED lighting module based on the plurality of sets of PWM signals respectively.

2. The LED lighting control integrated circuit of claim 1, further comprising:

a second timer, coupled to the second nonvolatile memory, for counting an accumulated operating time of the LED lighting module; and a plurality of second lookup tables stored in the second nonvolatile memory, the plurality of second lookup tables comprising:

a degradation-related lookup table for providing a plurality of degradation-related compensation signals based on the accumulated operating time or a plurality of color sensing signals in digital form;

an ambient-light-related lookup table for providing a plurality of ambient-light-related compensation signals based on an ambient light sensing signal in digital form; or a temperature-related lookup table for providing a plurality of temperature-related compensation signals based on a temperature sensing signal in digital form;

wherein the signal processing unit generates the plurality of sets of control signals further based on the plurality of degradation-related compensation signals, the plurality of ambient-light-related compensation signals, or the plurality of temperature-related compensation signals.

3. The LED lighting control integrated circuit of claim 2, wherein:

the second timer comprises a multiple time programmable nonvolatile memory or a pseudo multiple time programmable nonvolatile memory for storing the accumulated operating time;

the first nonvolatile memory is a one time programmable nonvolatile memory or a multiple time programmable nonvolatile memory; and the second nonvolatile memory is a one time programmable nonvolatile memory or a multiple time programmable nonvolatile memory;

wherein the LED lighting control integrated circuit is fabricated based on a Bipolar-CMOS-DMOS IC fabrication process or a High-Voltage IC fabrication process, and fabrication processes of the one time programmable nonvolatile memory, the pseudo multiple time programmable nonvolatile memory, and the multiple time programmable nonvolatile memory are compatible to the Bipolar-CMOS-DMOS IC fabrication process or the High-Voltage IC fabrication process.

4. The LED lighting control integrated circuit of claim 2, further comprising:

a first analog-to-digital converter coupled to the second nonvolatile memory for converting a temperature sensing signal in analog form to the temperature sensing signal in digital form;

a second analog-to-digital converter coupled to the second nonvolatile memory for converting an ambient light sensing signal in analog form to the ambient light sensing signal in digital form; or a plurality of third analog-to-digital converters coupled to the second nonvolatile memory for converting a plurality of color sensing signals in analog form to the plurality of color sensing signals in digital form.

5. The LED lighting control integrated circuit of claim 1, wherein:

the plurality of first lookup tables further comprise a voltage setting and trimming lookup table for providing a voltage setting and trimming calibration signal to the signal processing unit based on a number of series-connected LED sub-units in each LED unit of the LED lighting module, wherein the signal processing unit generates a voltage control signal based on the voltage setting and trimming calibration signal; and the driving module further comprises a voltage driving circuit coupled to the signal processing unit for providing a common voltage to the LED lighting module based on the voltage control signal.

6. The LED lighting control integrated circuit of claim 1, further comprising:

a third nonvolatile memory coupled to the signal processing unit;

a uniformity-recovery lookup table stored in the third nonvolatile memory for providing a plurality of uniformity-recovery compensation signals to the signal processing unit according to an LED damage situation of the LED lighting module, the uniformity-recovery lookup table being created based on predetermined uniformity-recovery regulations for recovering spatial uniformity of chromaticity and luminance concerning a variety of LED damage situations of the LED lighting module; and a current sensing unit coupled to the third nonvolatile memory and the plurality of driving circuits for generating a plurality of current sensing signals based on the plurality of sets of currents, wherein the LED damage situation of the LED lighting module is determined based on the plurality of current sensing signals;

wherein the third nonvolatile memory is a one time programmable nonvolatile memory or a multiple time programmable nonvolatile memory, and the signal processing unit generates the plurality of sets of control signals based on the plurality of current setting and trimming calibration signals in conjunction with the plurality of uniformity-recovery compensation signals.

7. The LED lighting control integrated circuit of claim 1, wherein:

the signal processing unit comprises:

a plurality of first buffers for outputting the plurality of sets of control signals respectively in serial-transmitting mode; and the PWM signal generating module further comprises:

a plurality of second buffers coupled between the plurality of first buffers and the plurality of PWM signal generators respectively for receiving the plurality of sets of serially transmitted control signals.

8. An LED lighting control integrated circuit comprising:

a first nonvolatile memory;

a plurality of first lookup tables stored in the first nonvolatile memory comprising a uniformity-recovery lookup table for providing a plurality of uniformity-recovery compensation signals according to an LED damage situation of an LED lighting module, the uniformity-recovery lookup table being created based on predetermined uniformity-recovery regulations for recovering spatial uniformity of chromaticity and luminance concerning a variety of LED damage situations of the LED lighting module;

a signal processing unit coupled to the first nonvolatile memory for generating a plurality of sets of control signals based on the plurality of uniformity-recovery compensation signals;

a pulse-width-modulation signal generating module coupled to the signal processing unit for generating a plurality of sets of PWM signals, the PWM signal generating module comprising:

a plurality of PWM signal generators for generating the plurality of sets of PWM signals based on the plurality of sets of control signals respectively;

a driving module coupled to the PWM signal generating module for providing a plurality of sets of currents to the LED lighting module, the driving module comprising:

a plurality of driving circuits coupled to the plurality of PWM signal generators respectively for providing the plurality of sets of currents to the LED lighting module based on the plurality of sets of PWM signals respectively; and a current sensing unit coupled to the first nonvolatile memory and the plurality of driving circuits for generating a plurality of current sensing signals based on the plurality of sets of currents;

wherein the LED damage situation of the LED lighting module is determined based on the plurality of current sensing signals.

9. The LED lighting control integrated circuit of claim 8, further comprising:

a first timer for counting an elapsed operating time of the LED lighting module each time after power-on;

a second timer for counting an accumulated operating time of the LED lighting module;

a second nonvolatile memory coupled to the signal processing unit, the first timer, and the second timer; and a plurality of second lookup tables stored in the second nonvolatile memory, the plurality of second lookup tables comprising:

a power-on-time-related lookup table for providing a plurality of power-on-time-related compensation signals based on the elapsed operating time;

a degradation-related lookup table for providing a plurality of degradation-related compensation signals based on the accumulated operating time or a plurality of color sensing signals in digital form;

an ambient-light-related lookup table for providing a plurality of ambient-light-related compensation signals based on an ambient light sensing signal in digital form; or a temperature-related lookup table for providing a plurality of temperature-related compensation signals based on a temperature sensing signal in digital form;

wherein the signal processing unit generates the plurality of sets of control signals based on the plurality of uniformity-recovery compensation signals in conjunction with the plurality of power-on-time-related compensation signals, the plurality of degradation-related compensation signals, the plurality of ambient-light-related compensation signals, or the plurality of temperature-related compensation signals.

10. The LED lighting control integrated circuit of claim 9, wherein:

the second timer comprises a multiple time programmable nonvolatile memory or a pseudo multiple time programmable nonvolatile memory for storing the accumulated operating time;

the first nonvolatile memory is a multiple time programmable nonvolatile memory or a one time programmable nonvolatile memory; and the second nonvolatile memory is a one time programmable nonvolatile memory or a multiple time programmable nonvolatile memory;

wherein the LED lighting control integrated circuit is fabricated based on a Bipolar-CMOS-DMOS IC fabrication process or a High-Voltage IC fabrication process, and fabrication processes of the one time programmable nonvolatile memory, the pseudo multiple time programmable nonvolatile memory, and the multiple time programmable nonvolatile memory are compatible to the Bipolar-CMOS-DMOS IC fabrication process or the High-Voltage IC fabrication process.

11. The LED lighting control integrated circuit of claim 9, further comprising:

a first analog-to-digital converter coupled to the second nonvolatile memory for converting a temperature sensing signal in analog form to the temperature sensing signal in digital form;

a second analog-to-digital converter coupled to the second nonvolatile memory for converting an ambient light sensing signal in analog form to the ambient light sensing signal in digital form; or a plurality of third analog-to-digital converter coupled to the second nonvolatile memory for converting a plurality of color sensing signals in analog form to the plurality of color sensing signals in digital form.

12. The LED lighting control integrated circuit of claim 8, wherein:

the plurality of first lookup tables further comprise a voltage setting and trimming lookup table for providing a voltage setting and trimming calibration signal to the signal processing unit based on a number of series-connected LED sub-units in each LED unit of the LED lighting module, wherein the signal processing unit generates a voltage control signal based on the voltage setting and trimming calibration signal; and the driving module further comprises a voltage driving circuit coupled to the signal processing unit for providing a common voltage to the LED lighting module based on the voltage control signal.

13. The LED lighting control integrated circuit of claim 8, wherein:

the signal processing unit comprises:

a plurality of first buffers for outputting the plurality of sets of control signals respectively in serial-transmitting mode; and the PWM signal generating module further comprises:

a plurality of second buffers coupled between the plurality of first buffers and the plurality of PWM signal generators respectively for receiving the plurality of sets of serially transmitted control signals.

14. An LED lighting control integrated circuit comprising:

a first nonvolatile memory;

a uniformity-recovery lookup table stored in the first nonvolatile memory for providing a plurality of uniformity-recovery compensation signals according to an LED damage situation of an LED lighting module, the uniformity-recovery lookup table being created based on predetermined uniformity-recovery regulations for recovering spatial uniformity of chromaticity and luminance concerning a variety of LED damage situations of the LED lighting module;

a signal processing unit coupled to the first nonvolatile memory for generating a plurality of sets of control signals based on the plurality of uniformity-recovery compensation signals;

a pulse-width-modulation signal generating module coupled to the signal processing unit for generating a plurality of sets of PWM signals, the PWM signal generating module comprising:

a plurality of PWM signal generators for generating the plurality of sets of PWM signals based on the plurality of sets of control signals respectively;

a driving module coupled to the PWM signal generating module for providing a plurality of sets of currents and a plurality of common voltages to the LED lighting module, the driving module comprising:

a plurality of driving circuits coupled to the plurality of PWM signal generators respectively for providing the plurality of sets of currents to the LED lighting module based on the plurality of sets of PWM signals respectively; and a voltage driving circuit coupled to the signal processing unit for providing a plurality of common voltages to the LED lighting module based on a voltage control signal generated by the signal processing unit; and a current sensing unit coupled to the first nonvolatile memory, the voltage driving circuit, and the plurality of driving circuits for generating a plurality of current sensing signals based on the plurality of sets of currents and a plurality of output currents from the voltage driving circuit;

wherein the LED damage situation of the LED lighting module is determined based on the plurality of current sensing signals.

15. The LED lighting control integrated circuit of claim 14, further comprising:

a second nonvolatile memory coupled to the signal processing unit; and a plurality of first lookup tables stored in the second nonvolatile memory, the plurality of first lookup tables comprising:

a current setting and trimming lookup table for providing a plurality of current setting and trimming calibration signals based on spacing or pitch of LED disposition of the LED lighting module; and a voltage setting and trimming lookup table for providing a voltage setting and trimming calibration signal to the signal processing unit based on a number of series-connected LED sub-units in each LED unit of the LED lighting module;

wherein the signal processing unit generates the plurality of sets of control signals based on the plurality of uniformity-recovery compensation signals and the plurality of current setting and trimming calibration signals, and the signal processing unit generates the voltage control signal based on the voltage setting and trimming calibration signal.

16. The LED lighting control integrated circuit of claim 15, wherein:

the first nonvolatile memory is a one time programmable nonvolatile memory or a multiple time programmable nonvolatile memory;

the second nonvolatile memory is a one time programmable nonvolatile memory or a multiple time programmable nonvolatile memory; and the LED lighting control integrated circuit is fabricated based on a Bipolar-CMOS-DMOS IC fabrication process or a High-Voltage IC fabrication process, and fabrication processes of the one time programmable nonvolatile memory and the multiple time programmable nonvolatile memory are compatible to the Bipolar-CMOS-DMOS IC fabrication process or the High-Voltage IC fabrication process.

17. The LED lighting control integrated circuit of claim 14, further comprising:

a first timer for counting an elapsed operating time of the LED lighting module each time after power-on;

a second timer for counting an accumulated operating time of the LED lighting module;

a third nonvolatile memory coupled to the signal processing unit, the first timer, and the second timer; and a plurality of second lookup tables stored in the third nonvolatile memory, the plurality of second lookup tables comprising:

a power-on-time-related lookup table for providing a plurality of power-on-time-related compensation signals based on the elapsed operating time;

a degradation-related lookup table for providing a plurality of degradation-related compensation signals based on the accumulated operating time or a plurality of color sensing signals in digital form;

an ambient-light-related lookup table for providing a plurality of ambient-light-related compensation signals based on an ambient light sensing signal in digital form; or a temperature-related lookup table for providing a plurality of temperature-related compensation signals based on a temperature sensing signal in digital form;

wherein the signal processing unit generates the plurality of sets of control signals based on the plurality of uniformity-recovery compensation signals in conjunction with the plurality of power-on-time-related compensation signals, the plurality of degradation-related compensation signals, the plurality of ambient-light-related compensation signals, or the plurality of temperature-related compensation signals.

18. The LED lighting control integrated circuit of claim 17, wherein:

the second timer comprises a multiple time programmable nonvolatile memory or a pseudo multiple time programmable nonvolatile memory for storing the accumulated operating time;

the first nonvolatile memory is a one time programmable nonvolatile memory or a multiple time programmable nonvolatile memory;

the third nonvolatile memory is a one time programmable nonvolatile memory or a multiple time programmable nonvolatile memory; and the LED lighting control integrated circuit is fabricated based on a Bipolar-CMOS-DMOS IC fabrication process or a High-Voltage IC fabrication process, and fabrication processes of the one time programmable nonvolatile memory, the pseudo multiple time programmable nonvolatile memory, and the multiple time programmable nonvolatile memory are compatible to the Bipolar-CMOS-DMOS IC fabrication process or the High-Voltage IC fabrication process.

19. The LED lighting control integrated circuit of claim 17, further comprising:

a first analog-to-digital converter coupled to the third nonvolatile memory for converting a temperature sensing signal in analog form to the temperature sensing signal in digital form;

a second analog-to-digital converter coupled to the third nonvolatile memory for converting an ambient light sensing signal in analog form to the ambient light sensing signal in digital form; or a plurality of third analog-to-digital converters coupled to the third nonvolatile memory for converting a plurality of color sensing signals in analog form to the plurality of color sensing signals in digital form.

20. The LED lighting control integrated circuit of claim 14, wherein:

the signal processing unit comprises:

a plurality of first buffers for outputting the plurality of sets of control signals respectively in serial-transmitting mode; and the PWM signal generating module further comprises:

a plurality of second buffers coupled between the plurality of first buffers and the plurality of PWM signal generators respectively for receiving the plurality of sets of serially transmitted control signals.

21. An LED lighting control integrated circuit comprising:

a first nonvolatile memory;

a current setting and trimming lookup table, stored in the first nonvolatile memory, for providing a plurality of current setting and trimming calibration signals based on spacing or pitch of LED disposition of an LED lighting module;

a second nonvolatile memory;

a uniformity-recovery lookup table, stored in the second nonvolatile memory, for providing a plurality of uniformity-recovery compensation signals to the signal processing unit according to an LED damage situation of the LED lighting module, the uniformity-recovery lookup table being created based on predetermined uniformity-recovery regulations for recovering spatial uniformity of chromaticity and luminance concerning a variety of LED damage situations of the LED lighting module;

a signal processing unit, coupled to the first nonvolatile memory and the second nonvolatile memory, for generating a plurality of sets of control signals based on the current setting and trimming calibration signals in conjunction with the uniformity-recovery compensation signals;

a pulse-width-modulation (PWM) signal generating module, coupled to the signal processing unit, for generating a plurality of sets of PWM signals, the PWM signal generating module comprising:

a plurality of PWM signal generators for generating the plurality of sets of PWM signals based on the plurality of sets of control signals respectively;

a driving module, coupled to the PWM signal generating module, for providing a plurality of sets of currents to the LED lighting module, the driving module comprising:

a plurality of driving circuits coupled to the plurality of PWM signal generators respectively for providing the plurality of sets of currents to the LED lighting module based on the plurality of sets of PWM signals respectively; and a current sensing unit, coupled to the second nonvolatile memory and the plurality of driving circuits, for generating a plurality of current sensing signals based on the plurality of sets of currents, wherein the LED damage situation of the LED lighting module is determined based on the plurality of current sensing signals;

wherein the second nonvolatile memory is a one time programmable nonvolatile memory or a multiple time programmable nonvolatile memory.

22. An LED lighting control integrated circuit comprising:

a first nonvolatile memory;

a current setting and trimming lookup table, stored in the first nonvolatile memory, for providing a plurality of current setting and trimming calibration signals based on spacing or pitch of LED disposition of an LED lighting module;

a timer for counting an accumulated operating time of the LED lighting module;

a second nonvolatile memory coupled to the timer;

a degradation-related lookup table, stored in the second nonvolatile memory, for providing a plurality of degradation-related compensation signals based on the accumulated operating time or a plurality of color sensing signals in digital form;

a signal processing unit, coupled to the first nonvolatile memory and the second nonvolatile memory, for generating a plurality of sets of control signals based on the plurality of current setting and trimming calibration signals in conjunction with the degradation-related compensation signals;

a pulse-width-modulation (PWM) signal generating module, coupled to the signal processing unit, for generating a plurality of sets of PWM signals, the PWM signal generating module comprising:

a plurality of PWM signal generators for generating the plurality of sets of PWM signals based on the plurality of sets of control signals respectively; and a driving module, coupled to the PWM signal generating module, for providing a plurality of sets of currents to the LED lighting module, the driving module comprising:

a plurality of driving circuits coupled to the plurality of PWM signal generators respectively for providing the plurality of sets of currents to the LED lighting module based on the plurality of sets of PWM signals respectively.

* * * * *